US008700194B2

(12) United States Patent
Bauer et al.

(10) Patent No.: US 8,700,194 B2
(45) Date of Patent: Apr. 15, 2014

(54) ROBUST MEDIA FINGERPRINTS

(75) Inventors: Claus Bauer, Beijing (CN); Regunathan Radhakrishnan, San Bruno, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 266 days.

(21) Appl. No.: 13/060,032

(22) PCT Filed: Aug. 26, 2009

(86) PCT No.: PCT/US2009/055017
§ 371 (c)(1),
(2), (4) Date: Feb. 21, 2011

(87) PCT Pub. No.: WO2010/027847
PCT Pub. Date: Mar. 11, 2010

(65) Prior Publication Data

US 2011/0153050 A1 Jun. 23, 2011

Related U.S. Application Data

(60) Provisional application No. 61/091,979, filed on Aug. 26, 2008.

(51) Int. Cl.
*G06F 17/00* (2006.01)

(52) U.S. Cl.
USPC ..... 700/94; 704/205

(58) Field of Classification Search
None
See application file for complete search history.

(56) References Cited

U.S. PATENT DOCUMENTS

| | | | | |
|---|---|---|---|---|
| 5,612,729 | A | 3/1997 | Ellis | |
| 6,963,975 | B1 | 11/2005 | Weare | |
| 7,013,301 | B2 | 3/2006 | Holm | |
| 7,328,149 | B2 * | 2/2008 | Jiang et al. | 704/207 |
| 2006/0217968 | A1 * | 9/2006 | Burges et al. | 704/205 |

(Continued)

FOREIGN PATENT DOCUMENTS

| | | |
|---|---|---|
| CN | 1662956 | 8/2005 |
| CN | 1711531 | 12/2005 |
| CN | 1983388 | 6/2007 |
| WO | 2009/046438 | 4/2009 |

OTHER PUBLICATIONS

Kozat, et al., "Robust Perceptual Image Hashing Via Matrix Invariants" Proceedings of IEEE International Conference on Image Processing (ICIP) Singapore, Sep. 2004.

(Continued)

*Primary Examiner* — Andrew C Flanders
*Assistant Examiner* — David Siegel

(57) ABSTRACT

Robust media fingerprints are derived from a portion of audio content. A portion of content in an audio signal is categorized. The audio content is characterized based, at least in part, on one or more of its features. The features may include a component that relates to one of several sound categories, e.g., speech and/or noise, which may be mixed with the audio signal. Upon categorizing the audio content as free of the speech or noise related components, the audio signal component is processed. Upon categorizing the audio content as including the speech related component and/or the noise related components, the speech or noise related components are separated from the audio signal. The audio signal is processed independent of the speech related component and/or the noise related component. Processing the audio signal includes computing the audio fingerprint, which reliably corresponds to the audio signal.

22 Claims, 2 Drawing Sheets

(56) References Cited

U.S. PATENT DOCUMENTS

| | | | | |
|---|---|---|---|---|
| 2007/0055500 | A1* | 3/2007 | Bilobrov | 704/217 |
| 2008/0082323 | A1* | 4/2008 | Bai et al. | 704/214 |
| 2009/0012638 | A1* | 1/2009 | Lou | 700/94 |
| 2009/0063277 | A1 | 3/2009 | Bernosky | |
| 2010/0238350 | A1 | 9/2010 | Radhakrishnan | |
| 2011/0022633 | A1 | 1/2011 | Bernosky | |
| 2011/0035382 | A1 | 2/2011 | Bauer | |

OTHER PUBLICATIONS

Kurth, et al., "Robust Real-Time-Identification of PCM Audio Sources" 114th Convention Mar. 22-25, 2003 Amsterdam, The Netherlands, pp. 1-10.
Burges, et al., "Distortion Discriminant Analysis for Audio Fingerprinting" IEEE Transactions on Speech and Audio Processing, May 2003, vol. XX, No. Y, pp. 1-10.
Battle, et al., "Automatic Song Identification in Noisy Broadcast Audio" Proc. of SIP, Aug. 2002.
Mihcak, et al., "A Perceptual Audio Hashing Algorithm: A Tool for Robust Audio Identification and Information Hiding" Proceedings of 4th International Information Hiding Workshop, Pittsburg, PA, Apr. 2001.
Venkatesan, et al., "Robust Image Hashing" Proc. IEEE ICIP, Vancouver, Canada, Sep. 2000.
Casey, et al., "Separation of Mixed Audio Sources by Independent Subspace Analysis" Proceeding of International Computer Music Conference, Berlin, Germany, Aug. 2000.
Raj, et al., "Latent Dirichlet Decomposition for Single Channel Speaker Separation" Proc. of ICASSP 2006, pp. V-821-V-824.
Raj, et al., "Latent Variable Decomposition of Spectograms for Single Channel Speaker Separation" 2005 IEEE Workshop on Applications of Signal Processing to Audio and Acoustics, New Paltz, NY, pp. 17-20.
Roweis, Sam "One Microphone Source Separation" in advances in neural information processing systems, vols. 13 pp. 793-799.
Smaragdis, Paris "Convolutive Speech Bases and their Application to Supervised Speech Separation" IEEE Transactions on Audio Speech and Language Processing, pp. 1-14.
Toyoda, et al., "Environmental Sound Recognition by Multilayered Neural Networks" in Proceedings of the Fourth International Conference on Computer and Information Technology, 2004, IEEE Computer Society, Washington, DC, 123-127.
Rabaoui, et al., "Improved One-Class SVM Classifier for Sounds Classification" AVSBS07, 2007, IEEE, pp. 117-122.
Scheirer, et al., "Construction and Evaluation of a Robust Multifeature Speech/Music Discriminator" IEEE Proc. ICASSP, 14(1), 1997.
Xiong, et al., "Effective and Efficient Sports Highlights Extraction Using the Minimum Description Length Criterion in Selecting GMM Structures" 2004 IEEE International Conference on Multimedia and Expo (ICME) pp. 1947-1950.
Ozer, et al., "Robust Audio Hashing for Audio Identification" EUSIPCO 2004, pp. 2091-2094.
Cano, et al., "A Review of Algorithms for Audio Fingerprinting" in Proceedings of IEEE Workshop on Multimedia Signal Processing, 2002, pp. 169-173.
Haitsma, et al., "A Highly Robust Audio Fingerprinting System" in Proc. ISMIR 2002.
Yoon, et al., "A Robust Mobile-based Music Information Retrieval System" Consumer Electronics, 2007, ICCE 2007. Digest of Technical Papers, International Conference on IEEE, pp. 1-2.
Lu, Chun-Shien, "Audio Fingerprinting Based on Analyzing Time-Frequency Localization of Signals" Multimedia Signal Processing, 2002 IEEE workshop pp. 174-177.
Cano, et al., "Robust Sound Modelling for Song Identification in Broadcast Audio" AES Convention (Apr. 2002).
Brandstein, et al., Microphone Arrays: Signal Processing Techniques and Applications (Digital Signal Processing) Springer Berlin.
Brown, et al., "Separation of Speech by Computational Auditory Scene Analysis" Speech Enhancement, Springer, New York 2005, pp. 371-402.
Shashanka, Madhusudana, "Latent Variable Framework for Modeling and Separating Single-Channel Acoustic Sources" Ph.D. Thesis, Boston University, 66 pages.

* cited by examiner

ROBUST MEDIA FINGERPRINTS

RELATED UNITED STATES APPLICATIONS

This application claims priority to U.S. Patent Provisional Application No. 61/091,979, filed 26 Aug. 2008. Additionally, this Application is related to U.S. Patent Provisional Application No. 60/997,943 filed on Oct. 5, 2007. Both are hereby incorporated by reference in their entirety.

TECHNOLOGY

The present invention relates generally to media. More specifically, embodiments of the present invention relate to audio (acoustic) fingerprints.

BACKGROUND

Audio media comprise an essentially ubiquitous feature of modern activity. Multimedia content, such as most modern movies, includes more than one kind of medium, such as both its video content and an audio soundtrack. Modern enterprises of virtually every kind and individuals from many walks of life use audio media content in a wide variety of both unique and related ways. Entertainment, commerce and advertising, education, instruction and training, computing and networking, broadcast, enterprise and telecommunications, are but a small sample of modern endeavors in which audio media content find common use.

Audio media include music, speech and sounds recorded on individual compact disks (CD) or other storage formats, streamed as digital files between server and client computers over networks, or transmitted with analog and digital electromagnetic signals. It has become about as familiar to find users listening to music from iPods™, MP3 players and CDs while mobile, commuting, etc. as at home on entertainment systems or other more or less stationary audio reproduction devices. Concerts from popular bands are streamed over the internet and enjoyed by users as audio and/or viewed as well in webcasts of the performance. Extremely portable lightweight, small form factor, low cost players of digital audio files have gained widespread popularity. Cellular phones, now essentially ubiquitous, and personal digital assistants (PDA) and handheld computers all have versatile functionality. Not just telecommunication devices, modern cell phones access the Internet and stream audio content therefrom.

As a result of its widespread and growing use, vast quantities of audio media content exist. Given the sheer quantity and variety of audio media content that exists, and the expanding growth of that content over time, an ability to identify content is of value. Media fingerprints comprise a technique for identifying media content. Media fingerprints are unique identifiers of media content from which they are extracted or generated. The term "fingerprint" is aptly used to refer to the uniqueness of these media content identifiers, in the sense that human beings are uniquely identifiable, e.g., forensically, by their fingerprints. While similar to a signature, media fingerprints perhaps even more intimately and identifiably correspond to the content. Audio and video media may both be identified using media fingerprints that correspond to each medium.

Audio media are identifiable with audio fingerprints, which are also referred to herein, e.g., interchangeably, as acoustic fingerprints. An audio fingerprint is generated from a particular audio waveform as code that uniquely corresponds thereto. Essentially, the audio fingerprint is derived from the audio or acoustic waveform. For instance, an audio fingerprint may comprise sampled components of an audio signal. As used herein, an audio fingerprint may thus refer to a relatively low bit rate representation of an original audio content file. Storing and accessing the audio fingerprints however may thus be efficient or economical, relative to the cost of storing an entire audio file, or portion thereof, from which it is derived.

Upon generating and storing an audio fingerprint, the corresponding waveform from which the fingerprint was generated may thereafter be identified by reference to its fingerprint. Audio fingerprints may be stored, e.g., in a database. Stored audio fingerprints may be accessed, e.g., with a query to the database in which they are stored, to identify, categorize or otherwise classify an audio sample to which it is compared. Acoustic fingerprints are thus useful in identifying music or other recorded, streamed or otherwise transmitted audio media being played by a user, managing sound libraries, monitoring broadcasts, network activities and advertising, and identifying video content (such as a movie) from audio content (such as a soundtrack) associated therewith.

The reliability of an acoustic fingerprint may relate to the specificity with which it identifiably, e.g., uniquely, corresponds with a particular audio waveform. Some audio fingerprints provide identification so accurately that they may be relied upon to identify separate performances of the same music. Moreover, some acoustic fingerprints are based on audio content as it is perceived by the human psychoacoustic system. Such robust audio fingerprints thus allow audio content to be identified after compression, decompression, transcoding and other changes to the content made with perceptually based audio codecs; even codecs that involve lossy compression (and which may thus tend to degrade audio content quality).

Audio fingerprints may be derived from an audio clip, sequence, segment, portion or the like, which is perceptually encoded. Thus the audio sequence may be accurately identified by comparison to its fingerprint, even after compression, decompression, transcoding and other changes to the content made with perceptually based audio codecs; even codecs that involve lossy compression, which may thus tend to degrade audio content quality (which may be practically imperceptible to detection). Moreover, audio fingerprints may function robustly over degraded signal quality of its corresponding content and a variety of attacks or situations such as off-speed playback.

Audio media content may be conceptually, commercially or otherwise related in some way to separate and distinct instances of content. The content that is related to the audio content which may include, but is not limited to other audio, video or multimedia content. For instance, a certain song may relate to a particular movie in some conceptual way. Other example may be text files or a computer graphics that relate to a given speech, lecture or musical piece in some commercial context.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF THE DRAWINGS

The present invention is illustrated by way of example, and not by way of limitation, in the figures of the accompanying drawings and in which like reference numerals refer to similar elements and in which.

DESCRIPTION OF EXAMPLE EMBODIMENTS

Figure 1:
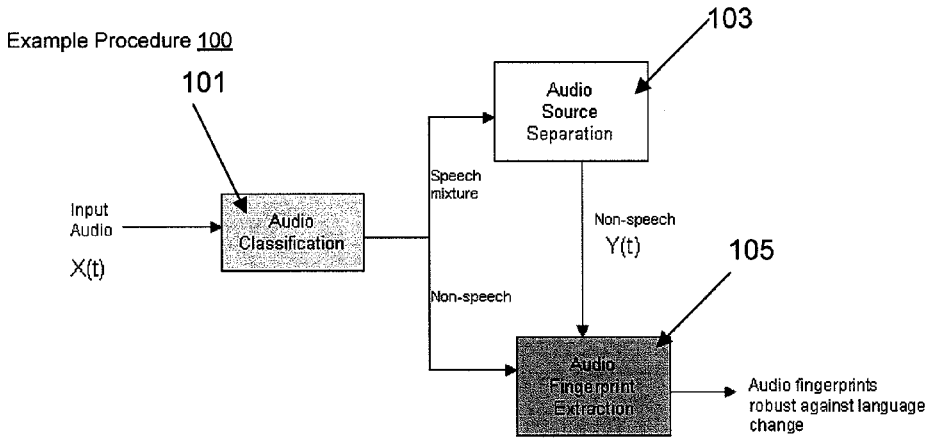
FIG. 1 depicts a first example procedure, according to an embodiment of the present invention.

Robust media fingerprints are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily occluding, obscuring, or obfuscating the present invention.

OVERVIEW

Example embodiments described herein relate to robust media fingerprints. The fingerprints are robust with respect to components of an audio signal that relate to various sound categories, such as speech and/or noise related components. Audio fingerprints described herein may be linguistically robust. For instance, the audio fingerprints may reliably allow accurate or precise identification of a portion of multi-media content in which speech, rendered in one or multiple natural languages, comprises a component feature of the audio content thereof.

The speech component may be mixed with components from other sonic sources, such as background or foreground sounds, music, ambient sounds, sonic noise, or combinations thereof. Additionally or alternatively, the audio fingerprints may reliably allow accurate or precise identification of a portion of multi-media content with which noise is mixed. The noise component may arise, for instance, from ambient sounds that are captured along with music content played over loudspeakers, such as where a fingerprinted song is recorded at a public performance thereof by an arbitrary, random, or contrabanned microphone.

In an embodiment, robust media fingerprints are derived (e.g., computed, extracted, sampled from and indexed to) from a portion of audio content. A portion of content in an audio signal is categorized. The audio content is characterized based, at least in part, on one or more of its features. The features may include a component that relates to speech and/or a component that relates to noise. The speech related and/or noise related features may be mixed with the audio signal. Upon categorizing the audio content as free of the speech or noise related components, the audio signal component is processed. Upon categorizing the audio content as including the speech related component and/or the noise related components, the speech or noise related components are separated from the audio signal. The audio signal is processed independent of the speech related component and/or the noise related component. Processing the audio signal includes computing the audio fingerprint, which reliably corresponds to the audio signal.

Categorizing the content portion, in various embodiments, may include techniques that relate to source separation and/or audio classification. The source separation techniques may include identifying each of at least a significant portion of multiple sonic sources that contribute to a sound clip. Source separation may also include essentially ignoring one or more sonic sources that contribute to the audio signal.

Audio classification may include sampling the audio signal and determining at least one sonic characteristic of at least a significant portion of the components of the sampled content portion. The audio content portion, the features thereof, or the audio signal may then be characterized according to the sonic components contained therein. The sonic characteristics or components may relate to at least one feature category, which may include speech related components, music related components, noise related components and/or one or more speech, music or noise related components with one or more of the other components. In an embodiment, the audio content portion may be represented as a series of the features, e.g., prior to the classifying the audio content.

In an embodiment, either or both of the source separation or audio classification techniques may be selected to characterize the audio signal or audio content portion. The audio content portion is divided into a sequence of input frames. The sequence of input frames may include overlapping and/or non-overlapping input frames. For each of the input frames, multi-dimensional features, each of which is derived from one of the sonic components of the input frame, are computed. A model probability density may then be computed that relates to each of the sonic components, based on the multi-dimensional features.

NOMENCLATURE, TERMS AND EXAMPLE PLATFORMS

As used herein, the term "medium" (plural: "media") may refer to a storage or transfer container for data and other information. As used herein, the term "multimedia" may refer to media which contain information in multiple forms. Multimedia information files may, for instance, contain audio, video, image, graphical, text, animated and/or other information, and various combinations thereof. As used herein, the term "associated information" may refer to information that relates in some way to information media content. Associated information may comprise, for instance, auxiliary content.

As used herein, the term "media fingerprint" may refer to a representation of a media content file, which is derived from characteristic components thereof. Media fingerprints are derived (e.g., computed, extracted, generated, etc.) from the media content to which they correspond. As used herein, the terms "audio fingerprint" and "acoustic fingerprint" may, synonymously or interchangeably, refer to a media fingerprint that is associated with audio media with some degree of particularity (although an acoustic fingerprint may also be associated with other media, as well; e.g., a video movie may include an individually fingerprinted audio soundtrack). As used herein, the term "video fingerprint" may refer to a media fingerprint associated with video media with some degree of particularity (although a video fingerprint may also be associated with other media, as well). Media fingerprints used in embodiments herein may correspond to audio, video, image, graphical, text, animated and/or other media information content, and/or to various combinations thereof, and may refer to other media in addition to media to which they may be associated with some degree of particularity.

Media fingerprints, as described herein, may conform essentially to media fingerprints described in co-pending Provisional U.S. Patent Application No. 60/997,943 filed on Oct. 5, 2007, by Regunathan Radhakhrishnan and Claus Bauer, entitled "Media Fingerprints that Reliably Correspond to Media Content" and assigned to the assignee of the present invention, which is incorporated herein by reference for all purposes as if fully set forth herein.

An audio fingerprint may comprise unique code that is generated from an audio waveform, which comprises the audio media content, using a digital signal processing technique. Audio fingerprints may thus relate, for instance, to spectrograms associated with media content and/or audio signals.

Thus, while media fingerprints described herein represent the media content from which they are derived, they do not comprise and (e.g., for the purposes and in the context of the description herein) are not to be confused with metadata or other tags that may be associated with (e.g., added to or with) the media content. Media fingerprints may be transmissible with lower bit rates than the media content from which they are derived. Importantly, as used herein, terms like "deriving," "generating," "writing," "extracting," and/or "compressing," as well as phrases substantially like "computing a fingerprint," may thus relate to obtaining media fingerprints from media content portions and, in this context, may be used synonymously or interchangeably.

These and similar terms may thus relate to a relationship of media fingerprints to source media content thereof or associated therewith. In an embodiment, media content portions are sources of media fingerprints and media fingerprints essentially comprise unique components of the media content. Media fingerprints may thus function to uniquely represent, identify, reference or refer to the media content portions from which they are derived. Concomitantly, these and similar terms herein may be understood to relate that media fingerprints are distinct from meta data, tags and other descriptors, which may be added to content for labeling or description purposes and subsequently extracted therefrom. In contexts relating specifically to "'derivative' media content," the terms "derivative" or "derive" may further relate to media content that may represent or comprise other than an original instance of media content.

Indexing may be done when an original media file, e.g., a whole movie, is created. However, an embodiment provides a mechanism that enables the linking of a segment of video to auxiliary content during its presentation, e.g., upon a movie playback. An embodiment functions where only parts of a multimedia file are played back, presented on different sets of devices, in different lengths and formats, and/or after various modifications of the video file. Modifications may include, but are not limited to, editing, scaling, transcoding, and creating derivative works thereof, e.g., insertion of the part into other media. Embodiments function with media of virtually any type, including video and audio files and multimedia playback of audio and video files and the like.

Information such as auxiliary content may be associated with media content. In an embodiment, media fingerprints such as audio and video fingerprints are used for identifying media content portions. Media fingerprinting identifies not only the whole media work, but also an exact part of the media being presented, e.g., currently being played out or uploaded.

In an embodiment, a database of media fingerprints of media files is maintained. Another database maps specific media fingerprints, which represent specific portions of certain media content, to associated auxiliary content. The auxiliary content may be assigned to the specific media content portion when the media content is created. Upon the media content portion's presentation, a media fingerprint corresponding to the part being presented is compared to the media fingerprints in the mapping database. The comparison may be performed essentially in real time, with respect to presenting the media content portion.

Moreover, an embodiment presents fingerprints that are linguistically robust and/or robust to noise associated with content and thus may reliably (e.g., faithfully) identify content with speech components that may include speech in multiple selectable natural languages and/or noise. The fingerprints are robust even where the corresponding media content portion is used in derivative content, such as a trailer, an advertisement, or even an amateur or unauthorized copy of the media content, pirated for example, for display on a social networking site. In whatever format the media content portion is presented, it is recognized and linked to information associated therewith, such as the auxiliary content. In an embodiment, a portion of media content is used in a search query.

In an embodiment, a computer system performs one or more features described above. The computer system includes one or more processors and may function with hardware, software, firmware and/or any combination thereof to execute one or more of the features described above. The processor(s) and/or other components of the computer system may function, in executing one or more of the features described above, under the direction of computer-readable and executable instructions, which may be encoded in one or multiple computer-readable storage media and/or received by the computer system.

In an embodiment, one or more of the features described above execute in a decoder, which may include hardware, software, firmware and/or any combination thereof, which functions on a computer platform. The computer platform may be disposed with or deployed as a component of an electronic device such as a TV, a DVD player, a gaming device, a workstation, desktop, laptop, hand-held or other computer, a network capable communication device such as a cellular telephone, portable digital assistant (PDA), a portable gaming device, or the like. One or more of the features described above may be implemented with an integrated circuit (IC) device, configured for executing the features. The IC may be an application specific IC (ASIC) and/or a programmable IC device such as a field programmable gate array (FPGA) or a microcontroller.

Example Fingerprint Robustness

The example procedures described herein may be performed in relation to deriving robust audio fingerprints. Procedures that may be implemented with an embodiment may be performed with more or less steps than the example steps shown and/or with steps executing in an order that may differ from that of the example procedures. The example procedures may execute on one or more computer systems, e.g., under the control of machine readable instructions encoded in one or more computer readable storage media, or the procedure may execute in an ASIC or programmable IC device.

Embodiments relate to creating audio fingerprints that are robust, yet content sensitive and stable over changes in the natural languages used in an audio piece or other portion of audio content. Audio fingerprints are derived from components of a portion of audio content and uniquely correspond thereto, which allow their function as unique, reliable identifiers of the audio content portions from which they are derived. The disclosed embodiments may thus be used for identifying audio content. In fact, audio fingerprints allow precise identification of a unique point in time.

Moreover, audio fingerprints that are computed according to embodiments described herein essentially do not change (or change only slightly) if the audio signal is modified; e.g., subjected to transcoding, off-speed playout, distortion, etc. Each audio fingerprint is unique to a specific piece of audio content, such as a portion, segment, section or snippet thereof, each of which may be temporally distinct from the others.

Thus, different audio content portions all have their own corresponding audio fingerprint, each of which differs from the audio fingerprints that correspond to other audio content portions. An audio fingerprint essentially comprises a binary sequence of a well defined bit length. In a sense therefore, audio fingerprints may be conceptualized as essentially hash functions of the audio file to which the fingerprints respectively correspond.

Embodiments may be used for identifying, and in fact distinguishing between, music files, speech and other audio files that are associated with movies or other multimedia content. With movies for instance, speech related audio files are typically recorded and stored in multiple natural languages to accommodate audiences from different geographic regions and linguistic backgrounds. Thus, digital versatile disks (DVD) and BluRay™ disks (BD) of movies for American audiences may store audio files that correspond to (at least) both English and Spanish versions of the speech content. Some DVDs and BDs thus store speech components of the audio content in more than one natural language. For example, some DVDs with the original Chinese version of the movie "Shaolin Soccer" may store speech in several Chinese languages, to accommodate the linguistic backgrounds or preferences of audiences in Hong Kong and Canton (Cantonese), as well as Beijing (Putonghua or "Mandarin") and other parts of China, as well as in English and one or more European languages. Similarly, DVDs of "Bollywood" movies may have speech that is encoded in two or more of the multiple languages spoken in India, including for example Hindi, Urdu and English.

However, the audio files corresponding to various language versions of a certain movie are thus very different; they encode speech belonging to the movie in different languages. Linguistically (e.g., phonemically, tonally) and acoustically (e.g., in relation to the timbre and/or pitch of whoever intonated and pronounced it), the components of the audio content that relate to distinct natural languages differ. An instance of a particular audio content portion that has a speech component rendered in a first natural language (e.g., English) is thus typically acoustically distinct from (e.g., has at least some different audio properties than) another instance of the same content portion, which has a speech component rendered in a second natural language (e.g., a language other than English, such as Spanish). Although they represent the same content portion, each of the content instances with a linguistically distinct speech component may thus be conventionally associated with distinct audio fingerprints.

Ideally, an audio content instance that is rendered over a loudspeaker should be acoustically identical with an original or source instance of the same content, such as a prerecorded content source. However, acoustic noise may affect an audio content portion in a somewhat similar way. For example, a prerecorded audio content portion may be rendered to an audience over a loudspeaker array in the presence of audience generated and ambient noise, as well as reproduction noise associated with the loudspeaker array, amplifiers, drivers and the like. Upon re-recording the content portion as rendered to the audience, such acoustic noise components are essentially mixed with the source content. Although they represent the same content portion, its noise component may acoustically distinguish the re-recorded instance from the source instance. Thus, the re-recorded instance and the source instance may thus be conventionally associated with distinct audio fingerprints.

Embodiments of the present invention relate to linguistically robust audio fingerprints, which may also enjoy robustness over noise components. An embodiment uses source separation techniques. An embodiment uses audio classification techniques.

As used herein, the term "audio classification" may refer to categorizing audio clips into various sound classes. Sound classifications may include speech, music, speech-with-music-background, ambient and other acoustic noise, and others. As used herein, the term "source separation" may refer to identifying individual contributory sound sources that contribute to an audio content portion, such as a sound clip. For instance, where an audio clip includes a mixture of speech and music, an audio classifier categorizes the audio as "speech-with-music-background." Source separation identifies sub bands, which may contribute to the speech components in a content portion, and sub bands that may contribute to the music components. It should be appreciated that embodiments do not absolutely or necessarily require the assignment of energy from a particular sub band to a particular sound source. For example, a certain portion of the energy may contribute to one (e.g., a first) source and the remaining energy portion to another (e.g., a second) source. Source separation may thus be able to reconstruct or isolate a signal by essentially ignoring one or more sources that may originally be present in an input audio mixture clip.

Example Audio Classification

Humans normally and naturally develop significant psychoacoustic skills, which allow them to classify audio clips to which they listen (even temporally brief audio clips), as belonging to particular sonic categories such as speech, music, noise and others. Audio classification extends some human-like audio classification capabilities to computers. Computers may achieve audio classification functionality with signal processing and statistical techniques, such as machine learning tools. An embodiment uses computerized audio classification. The audio classifiers detect selected sound classes. Training data is collected for each sound class for which a classifier is to be built. For example, several example "speech-only" audio clips are collected, sampled and analyzed. A statistical model is formulated therewith, which allow detection (e.g., classification) of speech signals.

Signal processing initially represents input audio as a sequence of features. For instance, initial audio representation as a feature sequence may be performed with division of the input audio into a sequence of overlapping and/or non-overlapping frames. A multi-dimensional feature (M) is extracted for each input frame, in which M corresponds to the number of features extracted for each audio frame, based on which classification is to be performed. An embodiment uses a Gaussian mixture model (GMM) to model the probability density function of the features for a particular sound class.

A value Y is the M dimensional random vector that represents the extracted features. A value K denotes the number of GMM components and $\pi$ denotes a vector of dimension K×1, where each $\pi_k$, (k=1, 2, . . . K) is the probability of each mixture component. Values $\mu_k$ and $R_k$ respectively denote a mean and a variance of the $k^{th}$ mixture component. Thus, $\mu_k$ is a vector of dimension M×1, which corresponds to the mean of the $k^{th}$ mixture component, and $R_k$ is a matrix of dimension M×M, which represents a covariance matrix of $k^{th}$ mixture component. The complete set of parameters characterizing the K-component GMM, may then be defined by a set of parameters $\theta=(\pi_k, \mu_k, R_k)$, where k=1, 2, . . . , K. The natural logarithm of the probability $p_y$ of the entire sequence $Y_n$ (n=1, 2 . . . N), and the probability $p_y$, may be respectively represented according to Equations 1 and 2, below.

$$\log p_y(y \mid K, \theta) = \sum_{n=1}^{N} \log\left(\sum_{k=1}^{K} p_{y_n}(y_n \mid k, \theta)\pi_k\right) \quad \text{(Equation 1)}$$

$$p_{y_n}(y_n \mid k, \theta) = \frac{1}{(2\pi)^{\frac{M}{2}} |R|^{\frac{1}{2}}} e^{-\frac{1}{2}(y_n-\mu_k)^T R_k^{-1}(y_n-\mu_k)} \quad \text{(Equation 2)}$$

In Equations 1 and 2 above, N represents the total number of feature vectors, which may be extracted from the training examples of a particular sound class being modeled. The parameters K and θ are estimated using expectation maximization, which estimates the parameters that maximize the likelihood of the data, as expressed in Equation 1, above. With model parameters for each sound class learned and stored, the likelihood of an input feature vector, being classified for a new audio clip, is computed under each of the trained models. An input audio clip is categorized into one of the sound classes based on the maximum likelihood criterion.

Essentially, training data is collected for each of the sound classes and a set of features is extracted therefrom, which is representative of the audio clips. Generative (e.g., GMM) and/or discriminative (e.g., support vector machine) machine learning is used to model a decision boundary between various signal types in the chosen feature space. New input audio clips are measured in relation to where the clips fall with respect to the modeled decision boundary and a classification decision is expressed. Various audio classification methods may be used to classify the audio content.

Example Source Separation

In addition to those skills that enable audio classification, humans also normally and naturally develop significant psychoacoustic skills that allow them to identify individual sound sources that are present in an audio clip. A person who receives a cell phone call from a second person, who calls while riding on a noisy train may, for example, be able to discern from the telephonically received sound clips two or more relatively predominant sound sources therein. For example, the person receiving the call may perceive both the voice of the second person as that person speaks, and noises associated with the train, such as engine noise, audible railway signals, track rumblings, squeaks, metallic clanging sounds and/or the voices of other train passengers. This ability helps the person receiving the phone call to focus on the speech, notwithstanding the concomitant train noise with which the speech may be convolved or contaminated (assuming that the noise volume is not too high to allow discernment of the speech). In other words, a listener is able to concentrate on speech parts of an audio clip, even in the presence of significant acoustic noise (again, as long as the noise is not too loud) during the playout of the speech parts of the signal. An embodiment relates to computerized audio source separation.

In an embodiment, a number 'N' of audio sources may be denoted $S_1, S_2, S_3, \ldots, S_N$. A number 'K' of microphone recordings of the mixtures of these sound sources may be denoted $X_1, X_2, X_3, \ldots, X_K$. Each of the K microphone recordings may be described according to Equation 3, below.

$$X_k(t) = \sum_{j=1}^{N} a_{kj} S_j(t - d_{kj}) \quad \text{(Equation 3)}$$

$$k = 1, 2 \ldots K;$$

The values $a_{kj}$ and $d_k$, respectively represent the attenuation and delay associated with the path between a sound source T and a microphone 'k'. Given this model of the observed mixture waveforms $X_1, X_2, X_3, \ldots, X_K$, source separation estimates mixing parameters ($d_{kj}$ and $a_{kj}$) and the N source signals $S_1, S_2, S_3, \ldots S_N$. Embodiments may function with practically any of a number of source separation techniques, some of which may use multiple microphones and others of which may use only a single microphone.

Upon identifying the individual sources in a sound mixture, a new audio signal may be constructed. For example, a number M of the N sound sources, which are present in the original mixture, may be selected according to Equation 4, below $$Y_k(t) = \sum_{j=1}^{M} a_{kj} S_j(t - d_{kj}) \quad \text{(Equation 4)}$$

$$k = 1.2 \ldots K:$$

in which $Y_k(t)$ is the reconstruction of the signal at microphone 'k' with only the first 'M' sound sources of the original N sources, $S_1, S_2, S_3, \ldots, S_N$. Audio classification and audio source separation may then be used to provide more intelligence about the input audio clip and may be used in deriving (e.g., computing, "extracting") audio fingerprints. The audio fingerprints are robust to natural language changes and/or noise.

Example Procedures

FIG. 1 depicts an example procedure 100, according to an embodiment of the present invention. Initially, an input signal X(t) of audio content is divided into frames. The audio content is classified in block 101, based on the features extracted in each frame.

Classification determines whether a speech (or noise) component is present in the input signal X(t). Where an audio frame contains no speech signal component, essentially all of the information contained in that frame may be used in block 105 for fingerprint derivation. Where the frame is found to have a speech component however, source separation is used in block 103. Source separation segregates the speech component of the input signal therefrom and reconstructs a speech-free signal Y(t). For an original input signal X(t) that has N sound sources, Y(t) may be reconstructed using, essentially exclusively, contributions from M=(N−1) sources, e.g., as in Equation 4, above. The speech components may essentially be discarded (or e.g., used with other processing functions). Thus, fingerprint derivation according to an embodiment provides significant robustness against language changes (and/or in the presence of significant acoustic noise). An embodiment may use audio classification, essentially exclusively. Thus, an input frame for audio fingerprint derivation may essentially be selected or discarded based on whether speech is present or not in the input frame.

In an embodiment, frames that contain a speech component are not completely discarded. Instead of discarding a speech bearing audio frame, an embodiment separates the speech component in block 103 from the rest of the frame's audio content. The audio content from other sound sources, which remains after separating out the speech components, is used for derivation of fingerprints from that audio frame in block 105. Embodiments thus allow efficient identification of movie sound tracks that may be recorded in different natural languages, as well as songs, which are sung by different and/or multiple vocalists, and/or in different languages, and/or with noise components.

Figure 2:
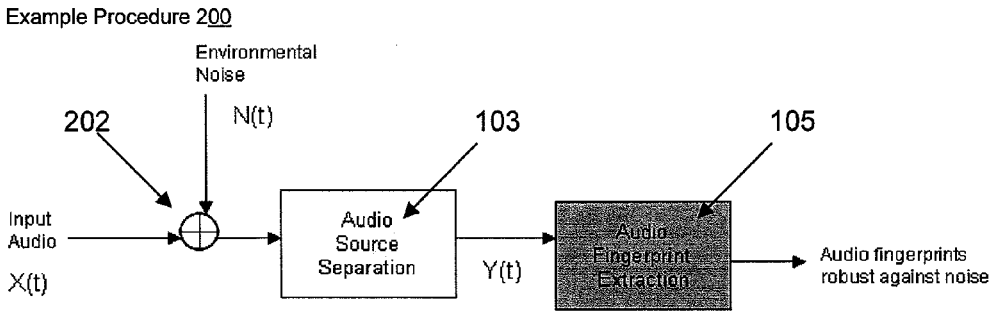
FIG. 2 depicts a second example procedure, according to an embodiment of the present invention.

Moreover, embodiments also allow intelligent audio processing in the context of audio fingerprint matching. FIG. 2 depicts an example procedure 200, according to an embodiment of the present invention. A stored audio fingerprint may be used to identify an instance of the same audio clip, even where that clip plays out in an environment with significant, even substantial ambient or other acoustic noise N(t), which may be added at block 202 to the input audio signal X(t). Audio source separation may be used. Source separation separates out the environmental, ambient, or other noise components from the input signal in block 204. Upon segregating the noise components, the audio fingerprints are computed from the quieted (e.g., de-noised) audio signal Y(t) in block 105. Thus, an embodiment allows accurate and efficient matching of the audio fingerprints derived from an audio clip at playout (or upload) time against audio fingerprints of the noise-free source, which may be stored, e.g., in a reference fingerprint database.

Procedures 100, and/or 200 may execute within one or more computer components, e.g., controlled or directed with computer readable code, which may be stored in a computer readable storage medium, such as a memory, register, disk, removable software media, etc. Procedures 100 and/or 200 may also execute in an appropriately configured or programmed IC. Thus, procedures 100 and 200 may, in relation to various embodiments, represent a process or system, or to code stored on a computer readable medium which, when executing with a processor in a computer system, controls the computer to perform methods described with reference to FIG. 1 and FIG. 2. Where procedures 100 and 200 represent systems, element identifiers 101, 103, 105, 202 and 204 may respectively represent components of the system, including an audio classifier, an audio source separator, a fingerprint generator, an adder or summing junction, and an audio source separator. In embodiments that relate to computer storage media, these elements may represent similarly functional software modules.

Figure 3:
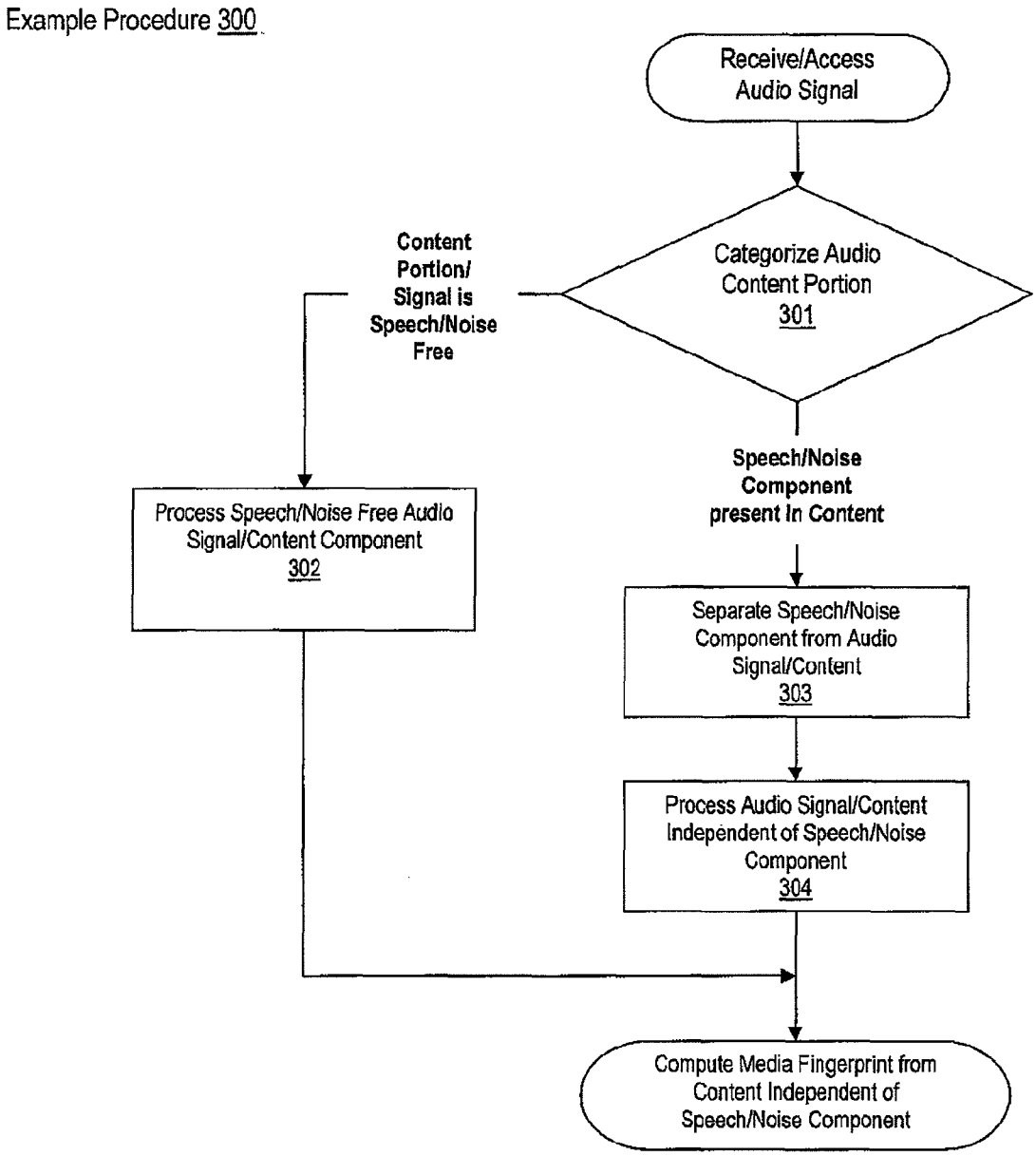
FIG. 3 depicts a flowchart for a third example procedure, according to an embodiment of the present invention.

FIG. 3 depicts a flowchart for an example procedure 300, according to an embodiment of the present invention. A media fingerprint is derived from a portion of audio content: The audio content comprises an audio signal. In step 301, the audio content portion is categorized, based, at least in part, on one or more features of audio content portion. The content features may include a component that relates to speech. The speech related component is mixed with the audio signal. The content features may also include a component that relates to noise, wherein. The noise related component is mixed with the audio signal.

Upon categorizing the audio content as free of the speech or noise related components, the audio signal component may be processed in step 302. Upon categorizing the audio content as including one or more of the speech or noise related components, the speech or noise related components are separated from the audio signal in step 303. In step 304, the audio signal is processed independent of the speech or noise related component. The processing steps 302 and 304 include computing the media fingerprint, which is linguistically robust and robust with noise components and thus reliably correspond to the audio signal.

Categorizing the content portion may include source separation and/or audio classification. The source separation techniques may include identifying each of at least a significant portion of multiple sonic sources that contribute to a sound clip. Source separation may also include essentially ignoring one or more sonic sources that contribute to the audio signal.

Audio classification may include sampling the audio signal and determining at least one sonic characteristic of at least a significant portion of the components of the sampled content portion. The audio content portion, the features thereof, or the audio signal may then be characterized according to the sonic components contained therein. The sonic characteristics or components may relate to at least one feature category, which may include speech related components, music related components, noise related components and/or one or more speech, music or noise related components with one or more of the other components. In an embodiment, the audio content portion may be represented as a series of the features, e.g., prior to the classifying the audio content.

In an embodiment, either or both of the source separation or audio classification techniques may be selected to characterize the audio signal or audio content portion. The audio content portion is divided into a sequence of input frames. The sequence of input frames may include overlapping and/or non-overlapping input frames. For each of the input frames, multi-dimensional features, each of which is derived from one of the sonic components of the input frame, are computed. A model probability density may then be computed that relates to each of the sonic components, based on the multi-dimensional features.

EQUIVALENTS, EXTENSIONS, ALTERNATIVES AND MISCELLANEOUS

Example embodiments for robust media fingerprints are thus described. In the foregoing specification, embodiments of the present invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method for deriving a media fingerprint from an audio content portion, comprising the steps of:

determining whether an audio signal of the audio content portion comprises any speech-related components;

in response to determining that the audio signal of the audio content portion comprises one or more speech-related components:

separating the one or more speech-related components from the audio signal;

computing the media fingerprint for the audio signal from which the one or more speech-related components have been separated;

wherein the media fingerprint reliably corresponds to the audio signal from which the one or more speech-related components have been separated;

wherein the one or more speech-related components are rendered in one or more of a plurality of different natural languages, and wherein the media fingerprint is computed for the audio signal from which the one or more speech-related components rendered in the one or more of the plurality of different natural languages have been separated; and using the media fingerprint, for the audio signal from which the one or more speech-related components have been separated, as a robust media fingerprint to identify the audio content portion.

2. The method as recited in claim 1, further comprising the step of:

performing one or more of source separation or audio classification.

3. The method as recited in claim 2 wherein the source separation comprises the step of: identifying each of at least a significant portion of a plurality of sonic sources that contribute to a sound clip.

4. The method as recited in claim 3 wherein the identifying step comprises identifying each of at least a significant portion of a plurality of sub bands, which contribute to the audio content portion.

5. The method as recited in claim 3 wherein the source separation further comprises the step of: essentially ignoring one or more sonic sources that contribute to the audio signal.

6. The method as recited in claim 2 wherein the audio classification comprises the steps of:

sampling the audio signal;

determining at least one sonic characteristic of at least a significant portion of the components of the content portion, based on the sampling step; and characterizing one or more of the audio content portion, features of the audio content portion, or the audio signal, based on the sonic characteristic.

7. The method as recited in claim 6 wherein each of the sonic characteristics relates to at least one feature category, which comprise: speech related components; music related components; noise related components; or one or more speech, music or noise related components with one or more of the other components.

8. The method as recited in claim 6, further comprising the step of: representing the audio content portion as a series of the features.

9. The method as recited in claim 2, further comprising the steps of:

selecting at least one of the source separation or audio classification for the determining step;

dividing the audio content portion into a sequence of input frames;

wherein the sequence of input frames comprises one or more of overlapping input frames or non-overlapping input frames; and for each of the input frames, computing a plurality of multi-dimensional features, each of which is derived from one of sonic components of the input frame.

10. The method as recited in claim 9 further comprising the step of: computing a model probability density relating to each of the sonic components, based on the multi-dimensional features.

11. The method as recited in claim 1, further comprising the steps of:

separating one or more noise related components from the audio signal; and performing the computing step independent of both the speech and noise related components.

12. A system, comprising: a computer readable storage medium; and at least one processor which, when executing code stored in the storage medium, causes or controls the system to perform steps of a method for deriving a media fingerprint from an audio content portion, the method steps comprising:

determining whether an audio signal of the audio content portion comprises any speech-related components;

in response to determining that the audio signal of the audio content portion comprises one or more speech-related components:

separating the one or more speech-related components from the audio signal;

computing the media fingerprint for the audio signal from which the one or more speech-related components have been separated;

wherein the media fingerprint reliably corresponds to the audio signal from which the one or more speech-related components have been separated;

wherein the one or more speech-related components are rendered in one or more of a plurality of different natural languages, and wherein the media fingerprint is computed for the audio signal from which the one or more speech-related components rendered in the one or more of the plurality of different natural languages have been separated; and using the media fingerprint, for the audio signal from which the one or more speech-related components have been separated, as a robust media fingerprint to identify the audio content portion.

13. The system as recited in claim 12, wherein the method further comprises the step of: performing one or more of source separation or audio classification.

14. The system as recited in claim 13 wherein the source separation comprises the step of: identifying each of at least a significant portion of a plurality of sonic sources that contribute to a sound clip.

15. The system as recited in claim 14 wherein the identifying step comprises identifying each of at least a significant portion of a plurality of sub bands, which contribute to the audio content portion.

16. The system as recited in claim 14 wherein the source separation further comprises the step of: essentially ignoring one or more sonic sources that contribute to the audio signal.

17. The system as recited in claim 13 wherein the audio classification comprises the steps of:

sampling the audio signal;

determining at least one sonic characteristic of at least a significant portion of the components of the content portion, based on the sampling step; and characterizing one or more of the audio content portion, features of the audio content portion, or the audio signal, based on the sonic characteristic.

18. The system as recited in claim 17 wherein each of the sonic characteristics relates to at least one feature category, which comprise: speech related components; music related components; noise related components; or one or more speech, music or noise related components with one or more of the other components.

19. The system as recited in claim 17, wherein the method further comprises the step of:

representing the audio content portion as a series of the features.

20. The system as recited in claim 17, wherein the method further comprises the steps of:

selecting at least one of the source separation or audio classification for the determining step;

dividing the audio content portion into a sequence of input frames;

wherein the sequence of input frames comprises one or more of overlapping input frames or non-overlapping input frames; and for each of the input frames, computing a plurality of multi-dimensional features, each of which is derived from one of sonic components of the input frame.

21. The system as recited in claim 20 wherein the method further comprises the step of: computing a model probability density relating to each of the sonic components, based on the multi-dimensional features.

22. The system as recited in claim 12, further comprising the steps of: separating one or more noise related components from the audio signal; and performing the computing step independent of both the speech and noise related components.

* * * * *